United States Patent [19]

Novak et al.

[11] 4,092,173

[45] May 30, 1978

[54] PHOTOGRAPHIC ELEMENTS COATED WITH PROTECTIVE OVERCOATS

[75] Inventors: Carl Peter Novak; Edward Dixon Morrison; Gerald Martin Leszyk, all of Rochester, N.Y.

[73] Assignee: Eastman Kodak Company, Rochester, N.Y.

[21] Appl. No.: 737,445

[22] Filed: Nov. 1, 1976

[51] Int. Cl.[2] ..... G03C 1/00

[52] U.S. Cl. ..... 96/119 R; 427/44; 96/86 P; 96/50 PL; 204/159.19; 204/159.23; 204/159.16

[58] Field of Search ..... 204/159.22, 159.19, 204/159.23, 159.16; 96/119 R, 86 P, 78, 50 PL; 427/44

[56] References Cited

U.S. PATENT DOCUMENTS

| | | | |
|---|---|---|---|
| 3,689,307 | 9/1972 | Johnson et al. | 427/44 |
| 3,689,310 | 9/1972 | Johnson et al. | 427/44 |
| 3,719,522 | 3/1973 | Johnson et al. | 427/44 |

*Primary Examiner*—John D. Welsh
*Attorney, Agent, or Firm*—A. P. Lorenzo

[57] ABSTRACT

Photographic elements, such as still films, motion picture films, paper prints, microfiche, and the like, are provided with a protective overcoat layer which is permanently bonded to the element and serves to protect it from abrasion and scratches. The protective overcoat is formed by coating the element with a radiation-curable composition, comprising an acrylated urethane, an aliphatic ethylenically-unsaturated carboxylic acid and a multifunctional acrylate, and irradiating the coating to bond it to the element and cure it to form a transparent, flexible, scratch-resistant, cross-linked polymeric layer. Protective overcoat layers can be applied to the image-bearing side of the element or to the support side of the element or to both sides.

40 Claims, No Drawings

PHOTOGRAPHIC ELEMENTS COATED WITH PROTECTIVE OVERCOATS

This invention relates in general to photography and in particular to photographic elements provided with protective coatings. More specifically, this invention relates to photographic elements, such as still films, motion picture films, paper prints, microfiche, and the like, which have a transparent, flexible, scratch-resistant layer over one or both sides of the element and to radiation-curable coating compositions for use in forming such protective layers.

Photographic elements having protective overcoat layers are well known and a wide variety of different coating compositions have been proposed in the past for use as protective overcoats. Such overcoats serve a number of different purposes, such as to provide protection against fingerprints, abrasion and scratching, to protect against water spotting, to provide a particular surface texture such as a matte surface, to provide protection against blocking, and to act as anti-reflection layers which reduce glare. Layers of a temporary nature which are intended to be removed after they have served their purpose and layers which are permanently bonded to the photographic element have been described in the prior art. Protective overcoats can be applied to photographic elements by coating solutions or dispersions of film-forming agents in organic solvents such as are described, for example, in U.S. Pat. Nos. 2,259,009; 2,331,746; 2,706,686; 3,113,867; 3,190,197 and 3,415,670; by coating of aqueous film-forming compositions such as are described, for example in U.S. Pat. Nos. 2,173,480; 2,798,004; 3,502,501 and 3,733,293; by coating of compositions containing discrete, transparent, solid particles of submicroscopic size as described in U.S. Pat. No. 2,536,764; by coating of plasticized polymer compositions as described in U.S. Pat. No. 3,443,946; by coating of polymerized perfluorinated olefins as described in U.S. Pat. No. 3,617,354; and by lamination of a protective layer as described, for example, in U.S. Pat. Nos. 3,397,980 and 3,697,277.

Protective overcoats known heretofore have suffered from various diasadvantages which have greatly limited their usefulness. For example, though numerous types of overcoats have been proposed, none has been fully satisfactory in providing abrasion and scratch resistance for photographic elements which are commonly subjected to severe conditions in handling and use, such as microfiche and motion picture films. Protective overcoats for such elements must meet exacting requirements with respect to factors such as transparency and flexibility as well as abrasion resistance and scratch resistance, and must be very strongly bonded to the underlying material to avoid the possibility of delimination. Protective overcoats meeting all of these requirements have long been sought without success.

It has now been discovered that photographic elements can be provided with protective overcoat layers meeting all of the many requirements to which such layers are subject by coating with a radiation-curable composition, comprising an acrylated urethane, an aliphatic ethlenically-unsaturated carboxylic acid, and a multifunctional acrylate, and subjecting the coating to radiation sufficient to cure the coating and bond it to the photographic element. Radiation curing of such a composition by, for example, the use of ultraviolet radiation or high energy electrons, results in the formation of a transparent, flexible, scratch-resistant, cross-linked polymeric layer which is strongly bonded to the photographic element so as to effectively resist delamination under vey stringent conditions.

The radiation-curable compositions described herein can be used to provide protective overcoats for many different types of photographic elements. For example, the photographic elements can be still films, motion picture films, paper prints, or microfiche. They can be black-and-white elements, color elements formed from a negative in a negative - positive process, or color elements formed directly by a reversal process. Radiation curing of the coatings described herein has been found, quite surprisingly, to provide strong bonding of the protective overcoat layer to all of these different types of photographic elements without in any way adversely affecting the element itself. The photographic elements can comprise any of a wide variety of supports. Typical supports include cellulose nitrate film, cellulose acetate film, poly (vinyl acetal) film, polystyrene film, poly(ethylene terephthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(-vinylpyrrolidone), acrylamide polymers, and the like. A particularly common example of an image-forming layer is a gelatino/silver halide emulsion layer and the compositions described herein provide excellent results as protective overcoats for such emulsion layers.

In a particular embodiment of the present invention the protective overcoat is applied only to the image-bearing side of the photographic element. In a second embodiment of the present invention the protective overcoat is applied only to the support side of the element. In a preferred embodiment of the present invention, the protective overcoat is applied to both sides of the element.

The first essential ingredient in the radiation-curable compositions employed in the practice of this invention is an acrylated urethane. The acrylated urethane can be a monomer, oligomer or polymer, or mixtures thereof. The acrylated urethanes are well known materials which have been used heretofore in radiation-curable compositions. Materials of this type are described, for example, in U.S. Pat. Nos. 3,509,234; 3,600,539; 3,694,415; 3,719,638 and 3,775,377 and in British Pat. No. 1,321,372. The acrylated urethanes are readily cross-linked by application of suitable radiation and are particularly advantageous in the coating compositions of this invention in that they form a very hard and very abrasion-resistant material upon curing. In a preferred embodiment of the invention, the acrylated urethane is prepared by reaction of a diisocyanate, such as tolylene diisocyanate, with a saturated aliphatic diol, such as 1,4-butane diol or neopentylglycol, and then with an unsaturated alcohol, such as 2-hydroxyethyl acrylate.

The second essential ingredient of the radiation-curable composition is an aliphatic ethylenically-unsaturated carboxylic acid. Acids of this type act as effective adhesion promoters in the compositions employed herein. Typical examples of this class of acids are acrylic acid, methacrylic acid, 3-chloro-2-methyl acrylic acid, 3-butenoic acid, 4-pentenoic acid, 2-hexenoic acid, and the like. Preferred acids are those of the formula:

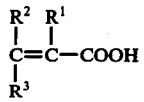

wherein $R^1$, $R^2$ and $R^3$ are hydrogen atoms or alkyl groups of 1 to 3 carbon atoms; while acrylic acid is especially preferred.

The third essential ingredient of the radiation-curable composition is a multifunctional acrylate, i.e., an acrylic monomer comprising at least two acrylic ester groups. Monomers of this class function in the radiation-curable compositions to increase hardness of the coating, improve adhesion and promote fast curing. Typical examples of this class of acrylic monomers are:

neopentylglycol diacrylate,
pentaerythritol triacrylate,
1,6-hexanediol diacrylate,
trimethylolpropane triacrylate
tetraethylene glycol diacrylate,
1,3-butylene glycol diacrylate,
trimethylolpropane trimethacrylate,
1,3-butylene glycol dimethacrylate,
ethylene glycol dimethacrylate,
pentaerythritol tetraacrylate,
tetraethylene glycol dimethacrylate,
1,6-hexanediol dimethacrylate,
ethylene glycol diacrylate,
diethylene glcyol diacrylate,
glycerol diacrylate,
glycerol triacrylate,
1,3-propanediol diacrylate,
1,3-propanediol dimethacrylate,
1,2,4-butanetriol trimethacrylate,
1,4-cyclohexanediol diacrylate,
1,4-cyclohexanediol dimethacrylate,
pentaerythritol diacrylate,
1,5-pentanediol dimethacrylate,
and the like.

Preferred multifunctional acrylates are those of the formula:

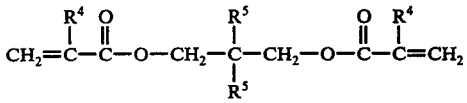

where each $R^4$ is independently selected from the group consisting of a hydrogen atom and an alkyl group of 1 to 2 carbon atoms, each $R^5$ is independently selected from the group consisting of an alkyl group of 1 to 6 carbon atoms and a radical of the formula:

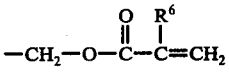

in which $R^6$ is a hydrogen atom or an alkyl group of 1 to 2 carbon atoms.

As explained hereinabove, the radiation-curable compositions used in the practice of this invention are compositions containing (1) an acrylated urethane, (2) an aliphatic ethylenically-unsaturated carboxylic acid, and (3) a multifunctional acrylate. Mixtures of two or more acrylated urethanes, of two or more aliphatic ethylenically-unsaturated carboxylic acids and of two or more multifunctional acrylates can be used, if desired, and may be advantageous in particular instances. Other ingredients can also be incorporated in the radiation-curable composition, for example, monoacrylates such as ethyl acrylate, butyl acrylate, 2-ethylhexyl acrylate and hydroxypropyl acrylate can be used to modify the viscosity of the composition, and acrylamide can be used as an adhesion promoter.

The proportions of each of the three essential components of the radiation-curable coating composition can be varied widely, as desired. Typically, the acrylated urethane is used in an amount of from about 4 to about 60% of the total composition on a weight basis, the aliphatic ethylenically-unsaturated carboxylic acid is used in an amount of from about 1 to about 20% of the total composition on a weight basis, and the multifunctional acrylate is used in an amount of from about 20 to about 95% of the total composition on a weight basis. The optimum amounts to use in a particular instance will depend upon the particular compounds involved and upon the characteristics of the photographic element which is being coated with the radiation-curable formulation. High concentrations of the aliphatic ethylenically-unsaturated carboxylic acid should usually be avoided in any coating composition which is to be in contact with a gelatin-containing layer of a photographic element as they can adversely affect such layers since the acid may attack the gelatin. Particularly preferred compositions, in view of the excellent combination of transparency, hardness, scratch resistance, abrasion resistance, flexibility and adhesion achieved therewith, are compositions comprised of an acrylated urethane, acrylic acid, trimethylolpropane triacrylate and neopentylglycol diacrylate, particularly those containing about 25% by weight acrylated urethane, about 10% by weight acrylic acid, about 35% by weight trimethylolpropane triacrylate and about 30% by weight neopentylglycol diacrylate. Use of the mixture of multifunctional acrylates, namely the combination of trimethylolpropane triacrylate and neopentylgylcol diacrylate, is especially advantageous in that the trimethylolpropane triacrylate is particularly effective in providing good adhesion and the neopentlygolcol diacrylate is particularly affective as a hardening monomer which gives increased scratch resistance without sacrificing flexibility.

In the practice of this invention, the particular ingredients and proportion of ingredients in the coating composition that will provide the best results is dependent on the composition of the photographic element. For example, the particular coating compositions which will provide optimum adhesion depend on the particular binder used in the image-bearing layer(s) or, if the element is to be coated on the support side, the particular material used as a support. Generally speaking, it is much easier to obtain adequate adhesion to the support than to obtain adequate adhesion to the image-bearing layer(s). A few simple experiments may be found to be necessary to formulate an optimum coating composition for any particular photographic element.

The photographic elements which are protected with overcoat layers in accordance with this invention are processed to form a visible image prior to being coated on the image-bearing side with the radiation-curable composition. Such processing can be carried out in any suitable manner. For example, black-and-white elements are typically processed in a sequence of steps comprising developing, fixing and washing, color prints in a sequence comprising color developing, bleaching, fixing (or combined bleach-fixing) and stabilizing, and color reversal elements in a sequence comprising black-and-white negative development, followed by reversal exposure or fogging, color development, bleaching, fixing (or combined bleach-fixing) and stabilizing. An advantageous manner of utilizing the invention described herein is to modify the conventional photogrphic processing operation to include, as final steps in the process following drying of the element, the steps of coating and curing to form the protective overcoat. The coating and curing steps can be carried out in a batch, semi-continuous or continuous manner, as desired.

Coating of the photographic element with the radiation-curable composition can be carried out in any convenient manner. For example, it can be carried out by dip coating, air-knife coating, roll coating, gravure coating, extrusion coating, bead coating, curtain coating, use of wire wound coating rods, and so forth. Typically, the coating deposited on the element will be a very thin coating such as wet coverage in the range from about 2 to about 20 cubic centimeters of coating composition per square meter of surface coated, more usually in the range from about 3 to about 10 cubic centimeters of coating composition per square meter, and preferably about 5 cubic centimeters of coating composition per square meter. The viscosity of the coating composition can vary widely depending on the particular method of coating which is chosen. Typically, satisfactory coatings can be readily formed on photographic elements from coating compositions having a viscosity in the range from about 25 to about 1000 centipoises, and more preferably in the range from about 75 to about 200 centipoises.

Apparatus and methods for curing of radiation-curable compositions by subjecting them to suitable forms of radiation are well known and any suitable radiation curing process can be used in carrying out this invention. For example, curing can be carried out by the application of ultraviolet radiation of suitable intensity. High energy ionizing radiation such as X-rays, gamma rays, beta rays and accelerated electrons can also be used to accomplish curing of the coating. Typically, the radiation used should be of a sufficient intensity to penetrate substantially all the way through the coated layer. The total dosage employed should be sufficient to bring about curing of the radiation-curable composition to form a solid plastic. Typically, dosages in the range of about 0.2 to about 50 megarads, more usualy in the range from about 0.5 to about 20 megarads, are employed. The coating compositions used in this invention are substantially completely convertible to a solid product so that the removal of solvents or diluents during the curing step is not necessary.

When the radiation-curable composition is cured by the use of ultraviolet radiation, a photoinitiator should be included in the composition. Many photoinitiators which are useful for such purpose are known to the art, for example, butyl benzoin ether, isobutyl benzoin ether, ethyl benzoin ether, benzophenone, benzoin, acetophenone dimethyl quinoxiline, 4,4'-bis(dimethylamino)benzophenone, and the like. Such photoinitiators may be used singly or in combination. The use of photoinitiators is not necessary when curing is carried out with high energy electrons.

Overcoating of photographic elements in the manner described herein can be advantageously carried out in appropriate cases prior to cutting the element to its final size. Thus, after the photograhic element has been processed to a visible image and dried, it can be coated with the radiation-curable composition, then irradiated, and then cut to size. In some instances it will be sufficient to coat the radiation-curable composition only on the side of the element bearing the image-containing layer(s) or only on the support side. In other instances it will be desirable to coat the photographic element with radiation-curable composition on both sides. For example, motion picture films and microfiche will typically be coated on both sides in view of the very severe handling that such articles are subject to in ordinary use and the need to reduce to an absolute minimum the formation of scratches on such articles. Both sides of the element can be coated simultaneously or each side can be coated separately depending on the particular method used for coating.

The radiation-curable compositions described herein adhere strongly to both the image-bearing side and the support side of photographic elements. They are effective in providing adhesion to materials with which it is ordinarily difficult to achieve adhesion, such as the cellulose triacetate or poly(ethylene terephthlate) which are commonly used as support materials for photograhic elements and the gelatino/silver haide emulsion layers or gelatin protective layers commonly employed on the image-bearing side of photographic elements. Irradiation of the composition to cure it to a transparent, flexible, scratch-resistant cross-linked polymeric layer can be carried out with no significant detrimental effect on the image-bearing layer(s), even with color elements in which the images are dye images.

The invention includes within its scope elements which comprise a photographic support, an image-bearing layer and a protective overcoat layer and elements which do not include an image-bearing layer which are intended to be used in the subsequent preparation of elements having an image-bearing layer.

The invention is further illustrated by the following examples of its practice.

EXAMPLE 1

An acrylated urethane was prepared by dissolving tolylene diisocyanate (TDI) and neopentylglycol (NPG) in neopentylglycol diacrylate and heating the resulting solution at 65° C for 4 hours, then adding 2-hydroxyethyl acrylate (HEA) and reacting for 6 hours in the presence of dibutyl tin dilaurate as a catalyst. The molar ratio of TDI:NPG:HEA was 1.0:0.5:0.8. The acrylated urethane produced by this method has the following structure:

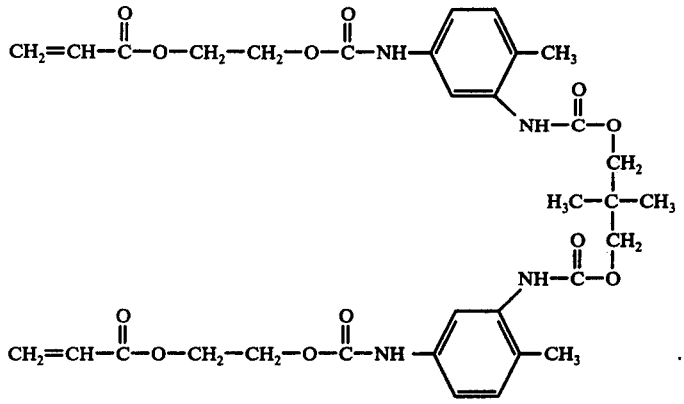

A coating composition was prepared by adding trimethylolpropane triacrylate, acrylic acid, methyldiethanol amine and benzophenone to the solution described above to give a composition as follows:

| Component | Weight % |
|---|---|
| Acrylated urethane | 26.4 |
| Neopentylglycol diacrylate | 25.8 |
| Trimethylolpropane triacrylate | 32.4 |
| Acrylic acid | 8.2 |
| Methyldiethanol amine | 4.3 |
| Benzophenone | 2.9 |

A color microfiche having a poly(ethylene terephthalate) film support and gelatino/silver halide emulsion layer was processed to a visible image, coated on both sides with the above-described coating composition, and cured by passing it under a bank of three 200 watt/inch high intensity mercury vapor UV lamps at a distance of 12 inches. The weight of cured coating on each side of the microfiche was approximately 19.2 grams/square meter. Curing of the coating resulted in the formation of a transparent, flexible, scratch-resistant, crosslinked polymeric layer which was strongly bonded to both the support and emulsion sides of the microfiche.

EXAMPLE 2

The color microfiche of Example 1 was coated with a radiation-curable composition as described below and cured in the same manner as in Example 1. The acrylated urethane used in this example was prepared by reaction of tolylene diisocyanate with 1,4-butane diol and then with 2-hydroxyethyl acrylate.

| Component | Weight % |
|---|---|
| Acrylated urethane | 51.8 |
| Butyl Acrylate | 5.7 |
| Neopentylglycol diacrylate | 15.5 |
| Pentaerythritol tetraacrylate | 6.6 |
| Acrylic acid | 17.7 |
| Butyl/isobutyl benzoin ether | 2.7 |

Results similar to those described in Example 1 were obtained.

EXAMPLE 3

The color microfiche of Example 1 was coated with a radiation-curable composition as described below and cured in the same manner as in Example 1:

| Component | Weight % |
|---|---|
| Acrylated urethane similar to that of Example 1 | 9.8 |
| Trimethylolpropane triacylate | 32.5 |
| Acrylic acid | 8.1 |
| Neopentylglycol diacrylate | 44.8 |
| Benzophenone | 2.4 |
| Butyl/isobutyl benzoid ether | 2.4 |

Results similar to those described in Example 1 were obtained.

EXAMPLE 4

A color print motion picture film having a cellulose triacetate film support and gelatino/silver halide emulsion layers was processed to a visible image, coated on both sides with a radiation-curable composition as described below, and cured in the same manner as in Example 1.

| Component | Weight % |
|---|---|
| Acrylated urethane similar to that of Example 1 | 8.7 |
| Trimethylolpropane triacrylate | 38.4 |
| Acrylic acid | 9.6 |
| Neopentylglycol diacrylate | 37.2 |
| Benzophenone | 3.8 |
| Methyldiethanolamine | 2.3 |

Curing of the coating resulted in the formation of a transparent, flexible, scratch-resistant, cross-linked polymeric layer which was strongly bonded to both the support and emulsion sides of the motion picture film.

EXAMPLE 5

The color print film of Example 4 was coated with a radiation-curable composition as described below and cured in the same manner as in Example 1.

| Component | Weight % |
|---|---|
| Acrylated urethane similar to that of Example 1 | 10.1 |
| Trimethylolpropane triacrylate | 31.3 |
| Acrylic acid | 9.6 |
| Neopentylglycol diacrylate | 42.5 |
| Methyldiethanol amine | 2.5 |
| Benzophenone | 4.0 |

Results similar to those described in Example 4 were obtained.

EXAMPLE 6

The color print film of Example 4 was coated with a radiation-curable composition as described below and cured in the same manner as in Example 1:

| Component | Weight % |
|---|---|
| Acrylated urethane similar to that of Example 1 | 9.6 |
| Trimethylolpropane triacrylate | 19.3 |
| Acrylic acid | 9.6 |
| Neopentylglycol diacrylate | 50.5 |
| Pentaerythritol tetraacrylate | 4.8 |
| Butyl/isobutyl benzoin ether | 3.8 |
| Benzophenone | 2.4 |

Results similar to those described in Example 4 were obtained.

The invention has been described in detail with particular reference to preferred embodiments thereof, but it will be understood that variations and modifications can be effected within the spirit and scope of the invention.

We claim:

1. A photographic element comprising
(1) a support,
(2) at least one image-bearing layer, and
(3) a protective overcoat layer which is permanently bonded to at least one side of said element; said protective overcoat layer having been formed by (a) coating said element with a radiation-curable coating composition which forms a transparent, flexible, scratch-resistant, crosslinked polymeric layer upon radiation curing, said coating composition comprising (1) an acrylated urethane, (2) an aliphatic ethylenically-unsaturated carboxylic acid, and (3) a multifunctional acrylate, and (b) subjecting said coating to radiation sufficient to cure said coating and bond it to said element.

2. A photographic element comprising
(1) a support,
(2) at least one image-bearing layer, and
(3) a protective overcoat layer which is permanently bonded to the image-bearing side of said element; said protective overcoat layer having been formed by (a) coating said image-bearing side with a radiation-curable coating composition which forms a transparent, flexible, scratch-resistant, cross-linked polymeric layer upon radiation curing, said coating composition comprising (1) an acrylated urethane, (2) an aliphatic ethylenically-unsaturated carboxylic acid, and (3) a multifunctional acrylate, and (b) subjecting said coating to radiation sufficient to cure said coating and bond it to said image-bearing side.

3. A photographic element comprising
(1) a support,
(2) at least one image-bearing layer, and
(3) a protective overcoat layer which is permanently bonded to the support side of said element; said protective overcoat layer having been formed by (a) coating said support side with a radiation-curable coating composition which forms a transparent, flexible, scratch-resistant, crosslinked polymeric layer upon radiation curing, said coating composition comprising (1) an acrylated urethane, (2) an aliphatic ethylenically-unsaurated carboxylic acid, and (3) a multifunctional acrylate, and (b) subjecting said coating to radiation sufficient to cure said coating and bond it to said support side.

4. A photographic element comprising
(1) a support,
(2) at least one image-bearing layer, and
(3) protective overcoat layers which are permanently bonded to both the image-bearing side of said element and the support side of said element, each said protective overcoat layer having been formed by (a) coating the respective side with a radiation-curable coating composition which forms a transparent, flexible, scratch-resistant, crosslinked polymeric layer upon radiation curing, said coating composition comprising (1) an acrylated urethane, (2) an aliphatic ethylenically-unsaturated carboxylic acid, and (3) a multifunctional acrylate, and (b) subjecting said coating to radiation sufficient to cure it and bond it to the side of the element on which it is coated.

5. A photographic element comprising
(1) a support,
(2) at least one image-bearing layer, and
(3) protective overcoat layers which are permanently bonded to both the image-bearing side of said element and the support side of said element, each said protective overcoat layer having been formed by (a) coating the respective side with radiation-curable coating composition which forms a transparent, flexible, scratch-resistant, cross-linked polymeric layer upon radiation curing, said coating composition comprising (1) an acrylated urethane, (2) an aliphatic ethylenically-unsaturated carboxylic acid, (3) a multifunctional acrylate, and (4) a photoinitiator, and (b) subjecting said coating to ultraviolet radiation sufficient to cure it and bond it to the side of said element on which it is coated.

6. A photographic element as claimed in claim 1 wherein said aliphatic ethylenically-unsaturated carboxylic acid has the formula:

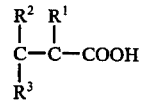

wherein $R^1$, $R^2$ and $R^3$ are independently selected from the group consisting of a hydrogen atom and an alkyl group of 1 to 3 carbon atoms.

7. A photographic element as claimed in claim 1 wherein said aliphatic ethylenically-unsaturated carboxylic acid is acrylic acid.

8. A photographic element as claimed in claim 1 wherein said multifunctional acrylate has the formula:

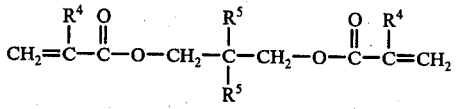

wherein each $R^4$ is independently selected from the group consisting of a hydrogen atom and an alkyl group of 1 to 2 carbon atoms, and each $R^5$ is independently selected from the group consisting of an alkyl group of 1 to 6 carbon atoms and a radical of the formula

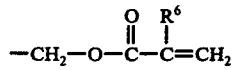

in which $R^6$ is a hydrogen atom or an alkyl group of 1 to 2 carbon atoms.

9. A photographic element as claimed in claim 1 wherein said multifunctional acrylate is trimethylolpropane triacrylate.

10. A photographic element as claimed in claim 1 wherein said multifunctional acrylate is pentaerythritol tetraacrylate.

11. A photographic element as claimed in claim 1 wherein said multifunctional acrylate is neopentylglycol diacrylate.

12. A photographic element as claimed in claim 1 wherein said acrylated urethane has the formula:

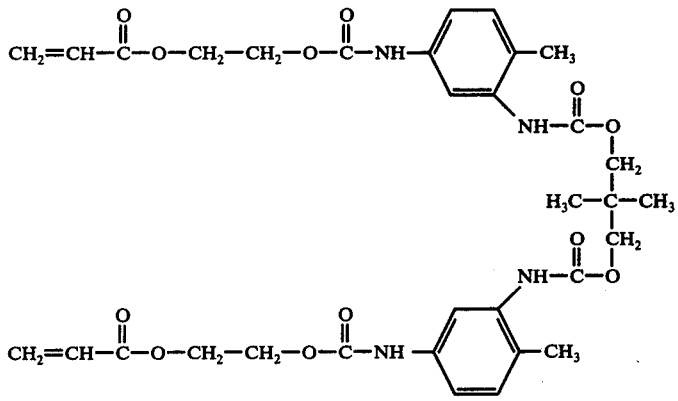

13. A photographic element as claimed in claim 1 wherein said radiation-curable coating composition comprises an acrylated urethane, acrylic acid, trimethylolpropane triacrylate and neopentylglycol diacrylate.

14. A photographic element as claimed in claim 1 wherein said radiation-curable composition consists essentially of about 25% by weight acrylated urethane, about 10% by weight acrylic acid, about 35% by weight trimethylolpropane triacrylate and about 30% by weight neopentylglycol diacrylate.

15. A photographic element as claimed in claim 1 wherein said support is a cellulose triacetate support and said image-bearing layer is an imagewise-exposed and processed gelatino/silver halide emulsion layer.

16. A photographic element as claimed in claim 1 wherein said support is a poly(ethylene terephthalate) support and said image-bearing layer is an imagewise-exposed and processed gelatino/silver halide emulsion layer.

17. A photographic element as claimed in claim 1 wherein said support is a polyethylene-coated paper support and said image-bearing layer is an imagewise-exposed and processed gelatino/silver halide emulsion layer.

18. A method of protecting a photographic element against abrasion and scratches which comprises (a) coating at least one side of said element with a radiation-curable coating composition comprising (1) an acrylated urethane, (2) an aliphatic ethylenically-unsaturated carboxylic acid, and (3) a multifunctional acrylate and (b) subjecting said coating to radiation sufficient to cure said coating and bond it to said element.

19. A method of protecting a photographic element against abrasion and scratches which comprises (a) coating both sides of said element with a radiation-curable coating composition comprising (1) an acrylated urethane, (2) an aliphatic ethylenically-unsaturated carboxylic acid, and (3) a multifunctional acrylate and (b) subjecting each said coating to radiation sufficient to cure it and bond it to the side of the element on which it is coated.

20. A method as claimed in claim 18 wherein said aliphatic ethylenically-unsaturated carboxylic acid has the formula:

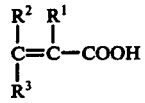

wherein $R^1$, $R^2$ and $R^3$ are independently selected from the group consisting of a hydrogen atom and an alkyl group of 1 to 3 carbon atoms.

21. A method as claimed in claim 18 wherein said aliphatic ethylenically-unsaturated carboxylic acid is acrylic acid.

22. A method as claimed in claim 18 wherein said multifunctional acrylate has the formula:

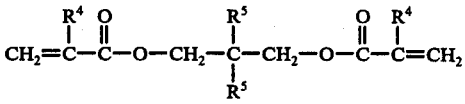

wherein each $R^4$ is independently selected from the group consisting of a hydrogen atom and an alkyl group of 1 to 2 carbon atoms, and each $R^5$ is independently selected from the group consisting of an alkyl group of 1 to 6 carbon atoms and a radical of the formula:

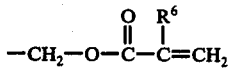

in which $R^6$ is hydrogen atom or an alkyl group of 1 to 2 carbon atoms.

23. A method as claimed in claim 18 wherein said acrylated urethane has the formula:

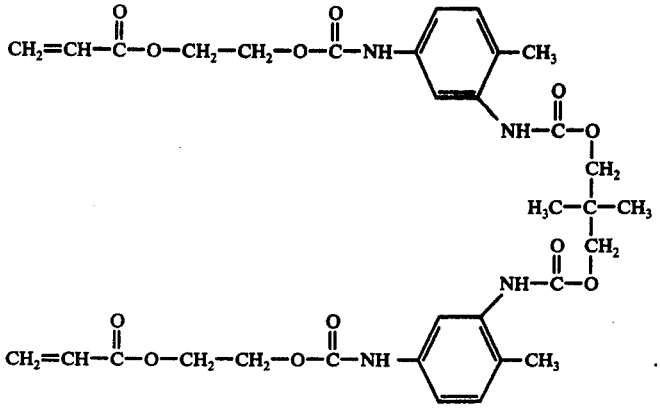

24. A method as claimed in claim 18 wherein said radiation-curable composition comprises an acrylated urethane, acrylic acid, trimethylolpropane triacrylate and neopentylglycol diacrylate.

25. A radiation-curable coating composition which is useful for the formation of protective overcoats on photographic elements, said composition comprising (1) an acrylated urethane, (2) an aliphatic ethylenically-unsaturated carboxylic acid and (3) a multifunctional acrylate.

26. A radiation-curable coating composition as claimed in claim 25 wherein said aliphatic ethylenically-unsaturated caboxylic acid has the formula:

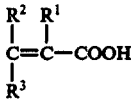

wherein $R^1$, $R^2$ and $R^3$ are independently selected from the group consisting of a hydrogen atom and an alkyl group of 1 to 3 carbon atoms.

27. A radiation-curable coating composition as claimed in claim 25 wherein said aliphatic ethylenically-unsaturated carboxylic acid is acrylic acid.

28. A radiation-curable coating composition as claimed in claim 25 wherein said multifunctional acrylate has the formula:

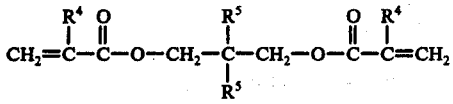

wherein each $R^4$ is independently selected from the group consisting of a hydrogen atom and an alkyl group of 1 to 2 carbon atoms, and each $R^5$ is independently selected from the group consisting of an alkyl group of 1 to 6 carbon atoms and a radical of the formula:

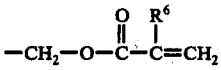

in which $R^6$ is a hydrogen atom or an alkyl group of 1 to 2 carbon atoms.

29. A radiation-curable coating composition as claimed in claim 25 wherein said acrylated urethane has the formula:

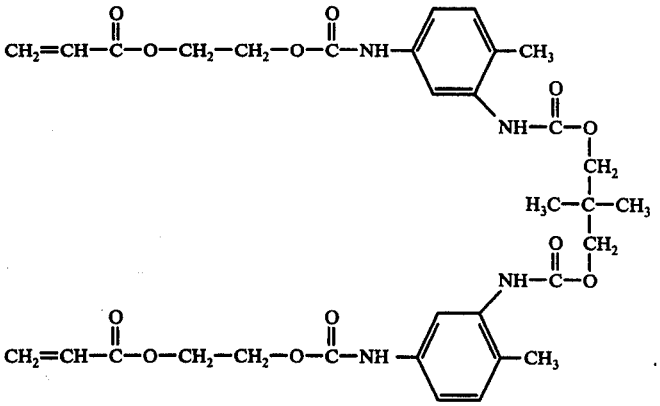

30. A radiation-curable coating composition as claimed in claim 25 wherein said acrylated urethane has the formula:

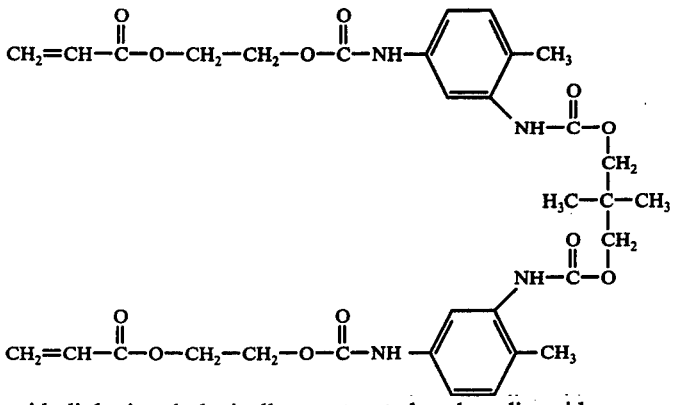

said aliphatic ethylenically-unsaturated carboxylic acid is acrylic acid, and said multifunctional acrylate is a mixture of trimethylolpropane triacrylate and neopentylglycol diacrylate.

31. An element comprising a photographic support and a protective overcoat layer, said protective overcoat layer having been formed by (a) coating said element with a radiation-curable coating composition which forms a transparent, flexible, scratch-resistant, cross-linked polymeric layer upon radiation curing, said coating composition comprising (1) an acrylated urethane, (2) an aliphatic ethylenically-unsaturated carboxylic acid, and (3) a multifunctional acrylate, and (b) subjecting said coating to radiation sufficient to cure said coating and bond it to said element.

32. An element as claimed in claim 31 wherein said aliphatic ethylenically-unsaturated carboxylic acid has the formula:

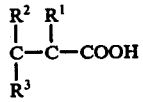

wherein $R^1$, $R^2$ and $R^3$ are independently selected from the group consisting of a hydrogen atom and an alkyl group of 1 to 3 carbon atoms.

33. An element as claimed in claim 31 wherein said aliphatic ethylenically-unsaturated carboxylic acid is acrylic acid.

34. An element as claimed in claim 31 wherein said multifunctional acrylate has the formula:

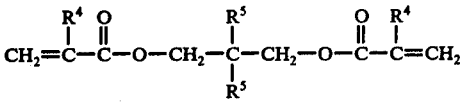

wherein each $R^4$ is independently selected from the group consisting of a hydrogen atom and an alkyl group of 1 to 2 carbon atoms, and each $R^5$ is independently selected from the group consisting of an alkyl group of 1 to 6 carbon atoms and a radical of the formula

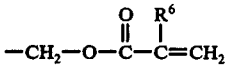

in which $R^6$ is a hydrogen atom or an alkyl group of 1 to 2 carbon atoms.

35. An element as claimed in claim 31 wherein said multifunctional acrylate is trimethylolpropane triacrylate.

36. An element as claimed in claim 31 wherein said multifunctional acrylate is pentaerythritol tetraacrylate.

37. An element as claimed in claim 31 wherein said multifunctional acrylate is neopentylglycol diacrylate.

38. An element as claimed in claim 31 wherein said acrylated urethane has the formula:

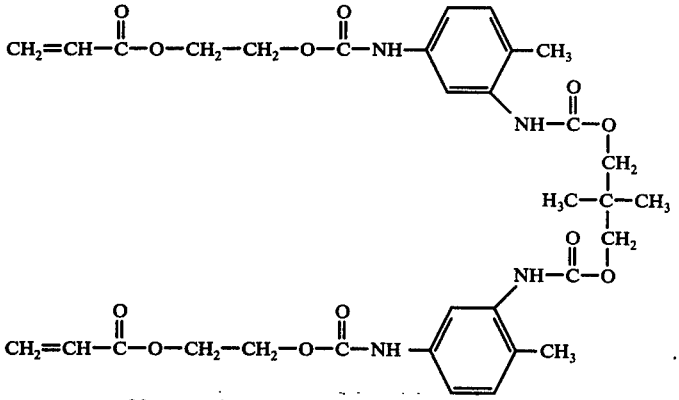

39. An element as claimed in claim 31 wherein said radiation-curable coating composition comprises an acrylated urethane, acrylic acid, trimethylolpropane triacrylate and neopentylglycol diacrylate.

40. An element as claimed in claim 31 wherein said radiation-curable composition consists essentially of about 25% by weight acrylated urethane, about 10% by weight acrylic acid, about 35% by weight trimethylolpropane triacrylate and about 30% by weight neopentylglycol diacrylate.

* * * * *